United States Patent [19]

Fuchs

[11] 4,314,463

[45] Feb. 9, 1982

[54] JACQUARD ATTACHMENT FOR WARP KNITTING MACHINES

[75] Inventor: Rudolf Fuchs, Hofen, Switzerland

[73] Assignee: Sulzer Brothers Limited, Winterthur, Switzerland

[21] Appl. No.: 149,680

[22] Filed: May 14, 1980

[30] Foreign Application Priority Data

May 18, 1979 [CH] Switzerland ..... 4645/79

[51] Int. Cl.[3] ..... D04B 23/00; D04B 27/00

[52] U.S. Cl. ..... 66/203; 66/204; 139/85

[58] Field of Search ..... 66/203, 204, 207, 213, 66/195; 139/86, 85, 59

[56] References Cited

U.S. PATENT DOCUMENTS 1,511,456 10/1924 Fuchs ..... 139/85
3,371,687 3/1968 Stead ..... 139/85 X
3,834,193 9/1974 Wilkens ..... 66/195
4,197,725 4/1980 Kohl ..... 66/213
4,240,275 12/1980 Fiedler ..... 66/203

FOREIGN PATENT DOCUMENTS 1221581 6/1960 France ..... 139/59

*Primary Examiner*—Ronald Feldbaum
*Attorney, Agent, or Firm*—Kenyon & Kenyon

[57] ABSTRACT

The deflecting elements about which the harness cords move are formed by rollers which are mounted on universal bearings in either of a fixed manner or a free manner. The rollers are obliquely disposed with respect to the shaft on which the rollers are mounted so as to direct the harness cords with a minimum of friction from the paths leading from the control elements of the jacquard boxes into the path leading to the guide bars of the knitting machine.

6 Claims, 6 Drawing Figures

JACQUARD ATTACHMENT FOR WARP KNITTING MACHINES

This invention relates to a jacquare attachment. More particularly, this invention relates to a jacquard attachment for warp knitting machines.

Heretofore, jacquard attachments have been known for warp knitting machines wherein a plurality of harness cords lead from a jacquare control unit to a plurality of guide bars of the warp knitting machine and in which pivotally mounted final control elements are used by the control unit to control the motion of the harness cords. Generally, the final control elements are the only driven elements of the jacquare control unit and swing, for example, in the shogging direction of the knitting machine but away from the shogging motion. If there are a multiplicity of guide bars or guide strips to be actuated by the jacquard attachment, there is usually not enough space for the jacquard attachment and the final control elements to be disposed so that the pivoting planes of each control element can coincide with the plane of the associated guide bar. Hence, the harness cords must be deflected from the planes of the control elements into the planes of the guide bars. In order to effect this deflection, the harness cords must be first obliquely guided out of the plane of the final control elements and subsequently guided into the plane of the guide bar motion. This requires at least two deflections at an angle in space.

Attempts have hitherto been made to bring about the double deflection of the harness cords by using vulcanized fiber harness boards or stell or glass rods or rollers obliquely disposed on their axes. However, deflection by harness boards or by rods, to a certain extent, results in relatively high friction. Further, in the case of rods, the lateral guidance of the harness cords is inadequate. While oblique rollers may provide lateral guidance, the harness cords become bunched together because the oblique position does not always coincide with the direction of the cord. As a result, considerable friction may occur.

Accordingly, it is an object of the invention to accurately guide the harness cords of a jacquard attachment about two deflection points in space without producing any significant friction.

It is another object of the invention to provide a relatively simple means of deflecting the hearness cords of a jacquard attachment to the guide bars of a warp knitting machine with minimal friction.

Briefly, the invention provides a deflecting system for a plurality of harness cords of a jacquard attachment which is comprised of a common shaft, a plurality of universal bearings mounted on and along the shaft and a plurality of deflecting means for the harness cords mounted on the universal bearings.

Each universal bearing includes a bearing ring which is secured to the shaft and which has an outer spherical surface.

Each deflecting means includes an inner race ring having an inner spherical surface journalled on the spherical surface of a bearing ring of a universal bearing, an outer race ring or roller having an outer circumferential groove for receiving a harness cord and a plurality of balls between the race rings. In addition, the outer race ring is obliquely disposed about the shaft.

The deflecting system is incorporated into a jacquard attachment for a warp knitting machine which includes at least one jacquard box having a plurality of movably mounted control elements and a plurality of harness cords. The harness cords are each connected to a respective control element in order to be actuated thereby. Each deflecting means is also disposed in spaced relation to the jacquard box for deflecting a respective harness cord from a first path extending from a control element to the deflecting means into a second path extending from the deflecting means obliquely to the first path. The paths are such that they are disposed in overlying spaced relation to each other.

The deflecting system is constructed so that each deflecting means may be fitted exactly on a universal bearing so that each individual grooved roller fits exactly in the direction of the corresponding harness cord. Alternatively, the deflecting means may be freely mounted on a respective universal bearing so that the oblique position of the roller automatically follows the course of the harness cord. This results in an efficient lateral guidance of the harness cord while the friction is reduced to that of the ball-bearing formed by the race rings and balls.

These and other objects and advantages of the invention will become more apparent from the following detailed description and appended claims taken in conjunction with the accompanying drawings in which:

Figure 1:
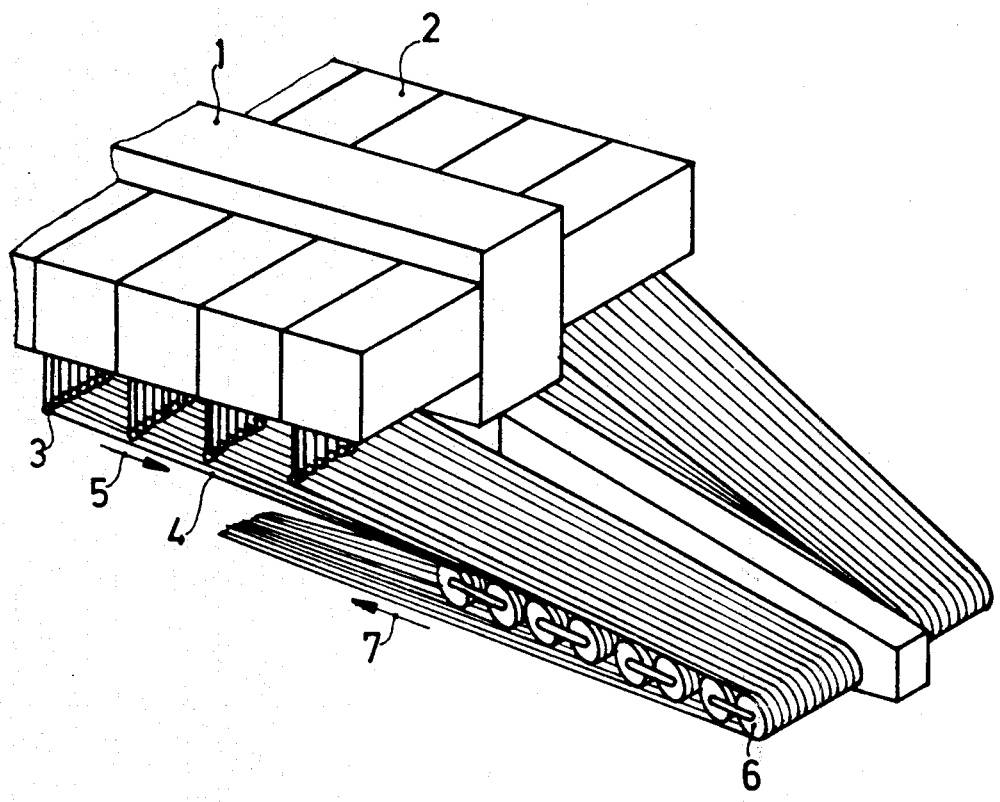
FIG. 1 illustrates a diagramatic perspective view of a jacquard attachment constructed in accordance with the invention.

Referring to FIG. 1, the jacquard attachment for a warp knitting machine (not shown) includes a gear box 1 and two sets of jacquard boxes or control units 2 which are disposed on each side of the gear box 1 in known manner. As indicated, each jacquard box 2 has a plurality of downwardly projecting final control elements 3 which are movable, i.e. pivotable. In addition, a plurality of harness cords 4 are secured to the respective control elements 3 and extend about a deflecting system which is disposed below and spaced from the jacquard boxes 2. These harness cords 4 lead to guide bars (not shown) or the like of the knitting machine so as to effect shogging motions in known manner.

Figure 2:
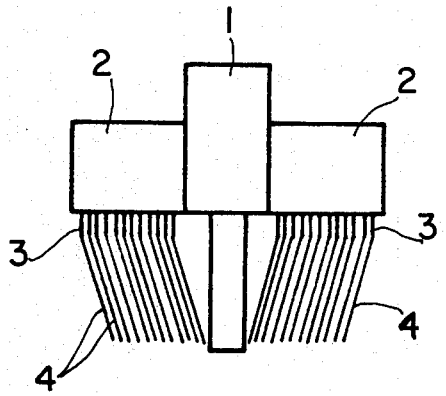
FIG. 2 illustrates a right side view of the attachment of FIG. 1.

The deflecting system includes a plurality of deflecting means 6 which, as shown in FIGS. 1 and 2, are disposed in spaced relation to the jacquard boxes 2 for deflecting each harness cord 4 from a first path 5 extending from a control element 3 to a deflecting means 6 and corresponding to the shogging direction into a second path 7 extending from the deflecting means 6 to a guide bar (not shown) obliquely to the first path 5. As shown, the paths 5, 7 are disposed in overlaying space relation to each other so that the second, or return, path 7 is disposed below the first path 5.

Figure 6:
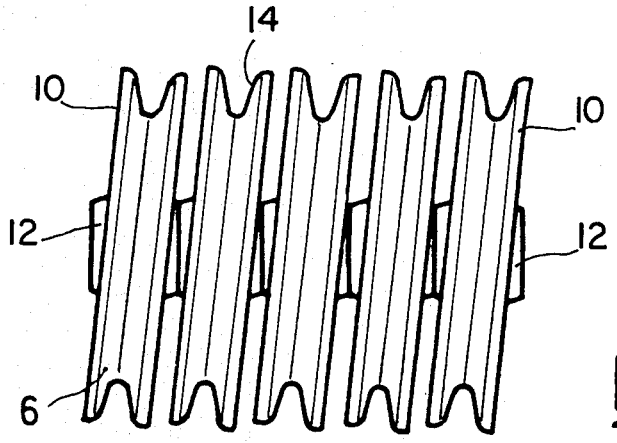
FIG. 6 illustrates a view of the deflecting system according to the system.
Figure 5:
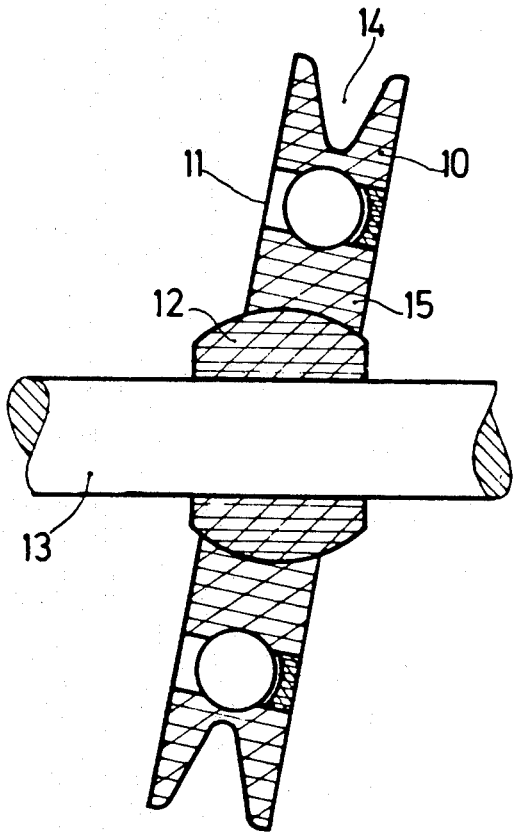
FIG. 5 illustrates a part cross-sectional view of a mounting arrangement for a deflecting means in accordance with the invention.

Referring to FIGS. 5 and 6, the deflecting system includes a stationary common shaft 13 on which the deflecting means 6 are mounted via universal bearings in closely spaced relation. As shown in FIG. 5, each deflecting means 6 includes a roller or outer race ring 10 provided with an outer circumferential groove 14 for receiving a harness cord (not shown), an inner race ring 15 and a plurality of balls 11 disposed between the race ring 10 and roller 15 within a suitable cage. The universal bearings are mounted on and along the shaft 13 and each includes a bearing ring 12 fixed to the shaft 13 in suitable manner with an outer spherical surface receiving an inner spherical surface of an inner race ring 15.

As shown in FIG. 5, each roller 10 is obliquely disposed about the universal bearing ring 12, i.e. each deflecting means 6 is obliquely disposed about the shaft 13.

The manner of mounting the inner race ring 15 on the bearing ring 12 can be such as to fix the oblique position of the roller 10 relative to the shaft 13 or may be such as to permit an automatic adjustment of the race ring 15 on the bearing ring 12. In this latter case, the deflecting means 6 is freely mounted to adapt to the direction of the paths 5, 7 of the harness cord 4.

Figure 4:
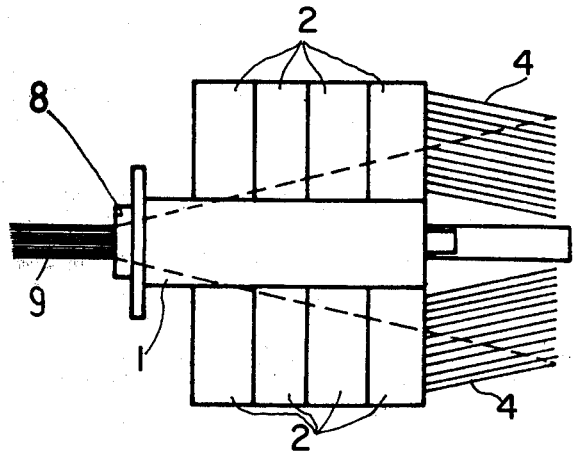
FIG. 4 illustrates a plan view of the attachment of FIG. 1.

Referring to FIG. 2, the control elements 4 of each jacquard box 2 are disposed on a greater lateral spacing than the corresponding guide bars (not shown) of the knitting machine. Thus, the deflecting means 6 (FIG. 1) serve to direct the harness cords 4 inwardly towards the central plane of the jacquard attachment. As shown in FIG. 4., after being directed inwardly, the harness cords 4 pass through a disc comb 8 of conventional structure for bundling in known manner prior to being secured to the guide bars (not shown).

Figure 3:
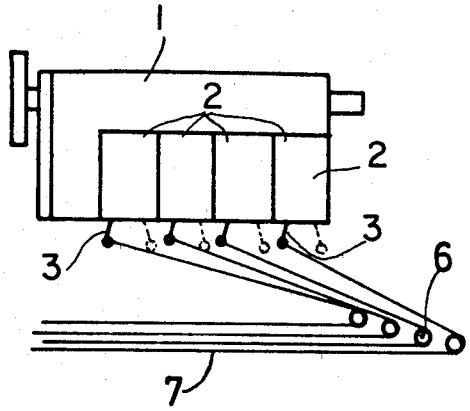
FIG. 3 illustrates a front view of the attachment of FIG. 1.

In operation, when the final control elements 3 are actuated, the harness cords 4 are first guided in the shogging direction in the path 5 outwards towards the deflecting rollers 6. After moving about the rollers 6, the harness cords 4 are deflected into a different plane, i.e. into the shogging direction in the path 7 as indicated in FIGS. 3 and 4. The harness cords 4 are then bundled by the disc comb 8 and are conveyed to the guide bars (not shown).

What is claimed is:

1. A jacquard attachment for a warp knitting machine, said attachment comprising at least one jacquard box having a plurality of movably mounted control elements and a plurality of harness cords, each said harness cord being connected to a respective control element;

a plurality of deflecting means; each said deflecting means being disposed in spaced relation to said jacquard box for deflecting each said harness cord from a first path extending from a respective control element to said deflecting means into a second path extending from said deflecting means obliquely to said first path, said paths being disposed in overlying spaced relation to each other; and a plurality of universal bearings, each said bearing having a respective deflecting means journalled thereon.

2. A jacquard attachment as set forth in claim 1 wherein each deflecting means includes a roller having an outer circumferential groove receiving a respective harness cord.

3. A jacquard attachment as set forth in claim 2 wherein each deflecting means further includes an inner race ring and a plurality of balls between said ring and said roller, and wherein each universal bearing includes an inner spherical surface on said inner race ring and a bearing ring having an outer spherical surface receiving said inner race ring thereon.

4. A jacquard attachment as set forth in claim 2 wherein each bearing ring of a respective universal bearing mounted on a common shaft.

5. A jacquard attachment as set forth in claim 1 wherein each deflecting means is freely mounted on a respective universal bearing.

6. A deflecting system for a plurality of harness cords of a jacquard attachment, said system comprising a common shaft;

a plurality of universal bearings mounted on and along said shaft, each said bearing including a bearing ring having an outer spherical surface; and a plurality of deflecting means for the harness cords, each said deflecting means including an inner race ring having an inner spherical surface journalled on a respective bearing ring surface, a roller having an outer circumferential groove for receiving a harness cord and a plurality of balls between said race ring and said roller, said roller being obliquely disposed about said shaft.

* * * * *